US005282495A

United States Patent [19]

Chamberlain

[11] Patent Number: 5,282,495

[45] Date of Patent: Feb. 1, 1994

[54] BEVERAGE CONTAINER PRESSURIZING SYSTEM

[76] Inventor: Paul M. Chamberlain, 12 Chestnut Hill Dr., Greensburg, Pa. 15601

[21] Appl. No.: 987,026

[22] Filed: Dec. 7, 1992

[51] Int. Cl.[5] ..... B65B 31/00

[52] U.S. Cl. ..... 141/4; 141/41; 141/382; 141/386; 285/158; 215/260

[58] Field of Search ..... 141/4, 11, 19, 37, 38, 141/41, 329, 330, 382, 383, 386; 215/260, 228; 53/88, 510, 432; 128/200.22, 203.28, 200.26, 205.13; 604/37, 142, 146, 212, 217; 222/631, 632, 633; 285/158, 174, 239, 240, 161

[56] References Cited

U.S. PATENT DOCUMENTS

| | | | |
|---|---|---|---|
| 42,721 | 5/1864 | Albee | 128/206.26 |
| 277,900 | 5/1883 | Hayes | 222/633 |
| 3,100,485 | 8/1963 | Bartlett, Jr. | 128/205.13 |
| 3,338,600 | 8/1967 | Wahl | 285/158 |
| 3,675,830 | 7/1972 | Clement | 222/385 |
| 4,098,271 | 7/1978 | Maddock | 128/205.13 |
| 4,142,645 | 3/1979 | Walton | 215/260 |
| 4,524,877 | 6/1985 | Saxby et al. | 215/228 |
| 4,723,670 | 2/1988 | Robinson et al. | 215/228 |
| 4,737,320 | 4/1988 | Rothschild | 141/19 |
| 4,763,802 | 8/1988 | Johnston | 215/228 |
| 4,768,665 | 9/1988 | Ballas | 215/228 |
| 4,823,968 | 4/1989 | Handzlik | 215/228 |
| 4,842,151 | 6/1989 | Scott | 215/228 |
| 4,899,896 | 2/1990 | Metzger | 215/228 |
| 4,981,233 | 1/1991 | Scheurer | 220/212 |
| 5,010,928 | 4/1991 | Ballas | 141/64 |

FOREIGN PATENT DOCUMENTS

| | | | |
|---|---|---|---|
| 416262 | 7/1925 | Fed. Rep. of Germany | 128/200.22 |

*Primary Examiner*—Henry J. Recla
*Assistant Examiner*—Steven O. Douglas
*Attorney, Agent, or Firm*—Lovercheck and Lovercheck

[57] ABSTRACT

An apparatus and method for introducing a gas under pressure into a container of liquid having a cap. A hole is punched through the cap. A hose, having an end, is extended through the hole to the inside of the cap, and the check valve tube forced into the hose from inside the cap. The tube forces the hose outward against the surface of the hole preventing leakage. A gas under pressure will be retained in the container by the check valve.

8 Claims, 1 Drawing Sheet

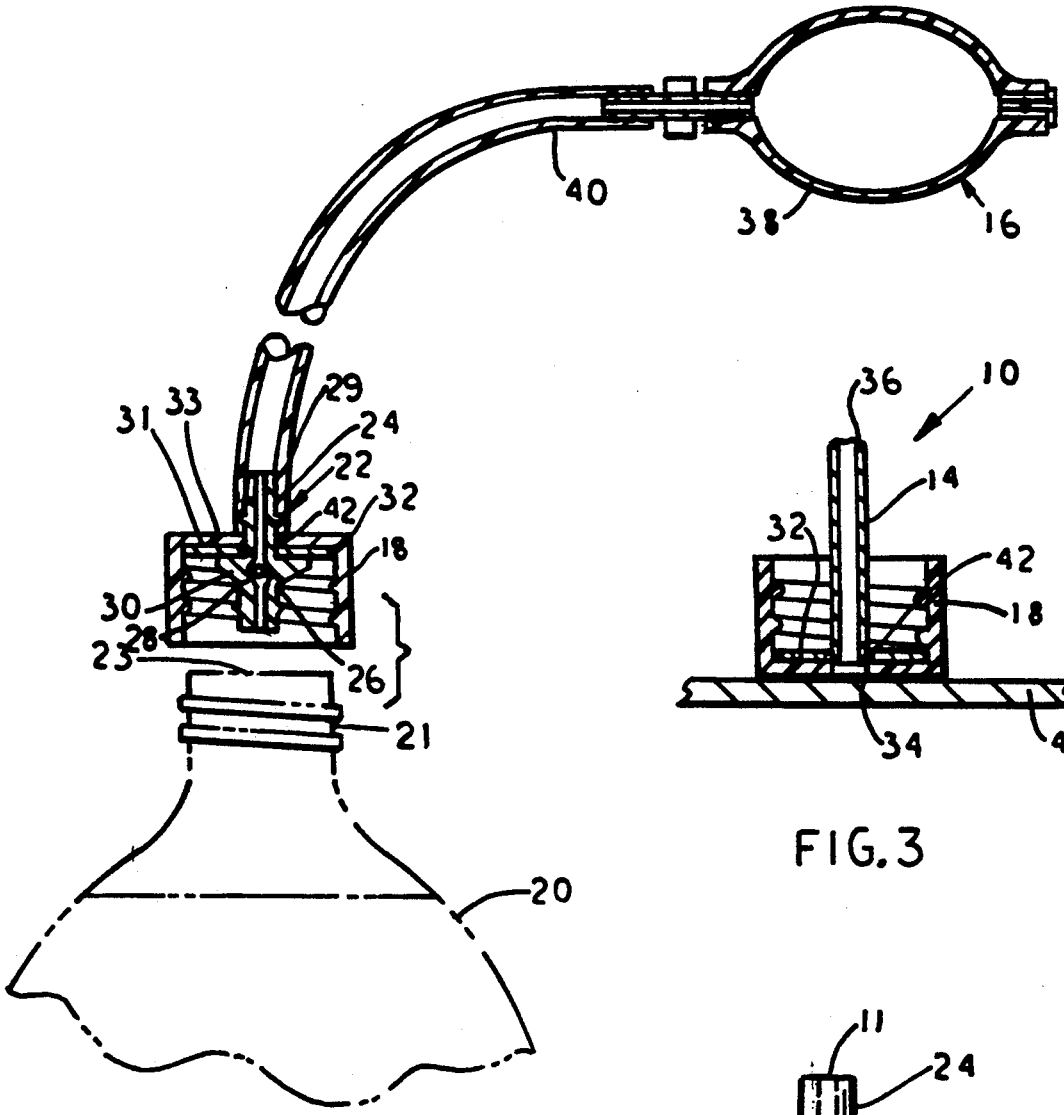
FIG. 1
FIG. 3
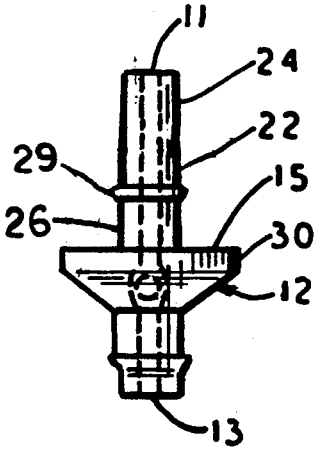
FIG. 2

BEVERAGE CONTAINER PRESSURIZING SYSTEM

BACKGROUND OF THE INVENTION

The present invention relates to pressurizing devices for use with opened containers of carbonated beverages, particularly where a portion of the contents has been consumed, and the remaining portion is to be stored.

A problem has long been recognized when containers containing carbonated beverages are opened. The beverages immediately begin to lose carbonation and becomes untasty. Resealing the container after use only partly solves the problem because the carbonation continues to escape from the liquid into the interior of the container above the liquid.

Applicant is aware of the following U.S. Pat. Nos.: 3,675,830 to Clement for a beverage pump dispenser. 4,524,877 to Saxby et al, for a pressurizing and closure apparatus for carbonated beverage containers. 4,723,670 to Robinson et al, for a pump closure for carbonated beverage container. 4,763,802 to Johnston for a bottle pump. 4,823,968 to Handzlik for a closure for carbonated beverage container with integral pump mechanism. 4,842,151 to Scott for a pressurizing closure apparatus for a carbonated beverage bottle. 4,899,896 to Metzger for a container pressuring apparatus. 4,981,233 to Scheurer for a positive pressure closure lid for beverage can. 5,010,928 to Ballas for a repressurizer for carbonated drink containers.

The above patents show apparatuses that introduce a gas through the cap of a container which are previous efforts to solve this problem.

SUMMARY OF THE INVENTION

To overcome the problems of the prior art of beverage pressurizing systems, applicant provides a kit made up of a punch, a check valve and a pump. The check valve having a tube attached thereto and extending therefrom. In a preferred embodiment, the tube is integrally connected to the check valve. The pump may be of the squeeze bulb type. The check valve and pump are connected by a hose. The pump is adapted to be releasably attached to one end of the hole, the other end attaches the distal end of the tube on the check valve. A hole of lesser diameter than the outside diameter of the hose is punched in the cap of the beverage container, the hose is extended through the hole in the cap from the outside. The tube of the check valve is forced into the hose compressing the hose between the tube and the cap around the hole forming a seal so that when gas, such as air, is pumped into the container, the check valve retains the gas in the container. The seal between the hose and the cap is accomplished by the resilient hose which when inserted in the hole in the cap, has an inside diameter smaller than the outside diameter of the tube on the check valve.

Thus, when the distal end of the tube is forced into the inside of the hose, the hose is forced outwardly and sandwiched between the tube and the cap thus forming an airtight seal between the tube and the cap. None of the patents of the prior art listed above show a structure or method similar to the structure or method described herein.

It is an object of the present invention to provide a kit for retaining carbonization in a liquid in a container.

Another object of the invention is to provide an improved method for retaining carbonization inside a beverage container.

Another object of the invention is to provide a kit for retaining carbonization in a beverage that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

FIG. 1 is a longitudinal cross sectional view of the pressurizing device supported on a cap with a valve, and container according to the invention.

FIG. 2 is a side view of the valve shown in FIG. 1.

FIG. 3 is a longitudinal cross sectional view of the punch in place in a cap for punching a hole in the cap.

DESCRIPTION OF THE PREFERRED EMBODIMENT(S)

Now with more particular reference to the drawings, shown is kit 10, made up of valve 12, punch 14 and pump 16. Kit 10 is used with punch 14 and caps like cap 18 may be supported on container 20. Cap 18 has a sealing cap liner 31, cap end wall 32 and outside surface 33. Container 20 has threaded neck 21 and opening 23.

Valve 12 has inlet 11, outlet 13, flange 15 and tube 22. Tube 22 has first distal end 24 and second end 26. First distal end 24 of tube 22 has an outer peripheral surface which forms a sealing surface with hose 4. Disk 30 is integral with intermediate part 28 of tube 22.

Punch 14 is in the form of a hollow cylindrical metallic member having a sharp first end 34 having a slightly larger outer diameter than the inside diameter of tube 22 to provide a clearance space for a layer of resilient material formed by hose 40 between tube 22 and cap 18. An impact receiving end 36 of punch 14 is adapted to be struck with a hammer or other impact tool to cut circular hole 42 in cap 18.

Pump 16 may be of rubber bulb 38 connected to hose 40. Hole 42 in cap 18 receives tube 22 through which air may be forced from hose 40 into container 20. Tube 22 has an annular flange 29 larger than tube 22 which holds tube 22 on hose 40.

In carrying out the invention, when cap 18 is removed from container 20, cap 18 may be inverted, as shown in FIG. 3. Cap end wall 32 rested on support 44, sharp first end 34 of punch 14 may be rested on cap end wall 32 and punch 14 is stuck forming hole 42. First distal end 24 of tube 22 may then be forced through hole 42 and cap liner 31 may rest against the inside of cap end wall 32. The operator may then insert tube 22 into hose 40 expanding hose 40 against the periphery of hole 42 forming a seal with the outside surface of said cap 18 as said flange 29 forms a seal with the inside of said cap 18. Gas, such as air, may then be pumped through valve 12 into container 20. Disk 30 may be pressed against cap liner 31 of cap end wall 32 and check valve 12 will thereby prevent gas in the form of air or other gasses that has been pumped into container 20 from escaping.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A pressurizing device for a container adapted to receive a cap, said device comprising:

a cap with a cap wall including an interior and an exterior surface having a hole therethrough;

a tube having a first distal end and a second end and a shoulder intermediate said tube ends adapted to sealingly engage said interior surface;

a check valve within said tube adapted to restrict flow from said first end to said second end of said tube;

a hose having first and second ends; and a pump connected to said first end of said hose;

said tube first end being adapted to be received in said hole;

said tube being adapted to be forced into said second end of said hose whereby said hose is adapted to be forced into sealing engagement with said cap wall around the periphery of said hole forming a seal with said exterior surface as said shoulder forms a seal with the interior surface of said cap.

2. The device recited in claim 1 wherein a punch is provided for punching said hole;

said punch being in the form of a hollow cylindrical member having a first end and a second end which has an outside diameter slightly larger than the outside diameter of said tube;

said first end of said punch having a first cutting edge; and, said second end of said punch being adapted to be struck with an impact tool whereby said hole can be punched in said cap to receive said tube.

3. The device recited in claim 1 wherein said shoulder is of larger diameter than the diameter of said hole whereby said hose is held to said cap.

4. A method of introducing gas under pressure into a container adapted to receive a cap comprising a cap wall having an inside surface and an outside surface;

a tube having a first end and a second end and a shoulder intermediate said tube ends adapted to sealingly engage said inside surface;

a check valve within said tube adapted to restrict flow from said first end to said second end of said tube; and a hose having first and second ends;

said method comprising: providing a punch;

providing a cap;

punching a hole in the outside surface of said cap with said punch;

inserting the first end of said tube through the hole and inserting said first end of said tube into the second end of said hose thereby forcing said hose into sealing engagement with said cap wall around the periphery of said hole forming a seal with said outside surface as said shoulder forms a seal with the inside surface of said cap;

placing said cap on said container; and, connecting a pump to said first end of said hose and pumping a gas into said container.

5. The method of claim 4 further providing a sealing disk which is disposed on said inside surface of said cap; and, said hole is punched through said sealing disk as well as through said cap whereby said sealing disk rests on said end wall.

6. The method of claim 5 comprising further sharpening one end of said punch.

7. The method of claim 6 further providing said punch with a slightly smaller diameter than the outside diameter of said hose.

8. The method of claim 7 wherein gases are pumped through said hose and said cap into said container and said check valve retains said gas in said container.

* * * * *